United States Patent [19]

Adams et al.

[11] Patent Number: 4,988,021

[45] Date of Patent: Jan. 29, 1991

[54] COLLAPSIBLE CLOTHES HANGER

[75] Inventors: Michael E. Adams, 2009 Walters Ave., Northbrook, Ill. 60062; John Fitch, Cary, Ill.

[73] Assignee: Michael E. Adams, Northbrook, Ill.

[21] Appl. No.: 399,766

[22] Filed: Aug. 28, 1989

[51] Int. Cl.[5] ..... A47G 25/14; A47G 25/40; A47G 25/28; A47G 25/36

[52] U.S. Cl. ..... 223/94; 223/85; 223/88; 223/89; 223/92

[58] Field of Search ..... 223/88, 89, 92, 94, 223/DIG. 3, DIG. 4, 85

[56] References Cited

U.S. PATENT DOCUMENTS

| | | | |
|---|---|---|---|
| 589,901 | 9/1897 | Lincoln et al. | 223/94 |
| 923,786 | 6/1909 | Geraci | 223/94 |
| 959,687 | 5/1910 | Altermatt | 223/94 |
| 1,236,022 | 11/1918 | Klesat | 223/94 |
| 1,907,943 | 8/1934 | Raymond | 223/64 |
| 2,290,722 | 7/1942 | Weingarten | 223/94 |
| 2,425,475 | 8/1947 | Isaacson | 223/94 |
| 2,509,754 | 5/1950 | Badalamenti | 223/94 |
| 2,518,367 | 8/1950 | Penhallegon | 223/94 |
| 2,906,442 | 9/1959 | McNutt | 223/94 |
| 3,531,028 | 9/1970 | Vazquez | 223/94 |
| 4,114,786 | 9/1978 | Wiese | 223/94 |
| 4,117,960 | 10/1978 | Bengsh | 223/94 |
| 4,227,632 | 10/1980 | Collis | 223/94 |
| 4,673,115 | 6/1987 | LaMont | 223/94 |
| 4,813,581 | 3/1989 | LaMont | 223/94 |

FOREIGN PATENT DOCUMENTS

| | | | |
|---|---|---|---|
| 157082 | 9/1939 | Fed. Rep. of Germany | 223/94 |
| 1429922 | 4/1963 | Fed. Rep. of Germany | 223/350 |
| 7607305 | 1/1977 | Netherlands | 223/94 |

*Primary Examiner*—Werner H. Schroeder
*Assistant Examiner*—Bibhu Mohanty
*Attorney, Agent, or Firm*—Hill, Van Santen, Steadman & Simpson

[57] ABSTRACT

A collapsible clothes hanger molded in one piece of a flexible material has a pair of hanger arms which are moved from a collapsed position to an extended position by one hand exerting s squeezing force on the flexible connections between the pair of hanger arms and a pair of flexible links that extend between the hanger arms and a center support member. The bendable links, whose motion is restricted by the center support member, fold upon themselves and draw the hanger arms upward into the extended position. The squeezing force which moves the hanger arms into the extended position lies in a horizontal plane so that the hand of the user can remain in a natural position during extension of the arms to a desired garment-supporting position. The hanger of a preferred embodiment is automatically locked in the extended position once this position is reached. The lock is released by again a single hand exerting a squeezing force, also in a horizontal plane, so that the hanger arms may move the collapsed position. The hanger arms, flexible links, and center support member are connected to one another by hinges. The locking mechanism of the preferred embodiments includes a push button release and extends from each of the hanger arms between the hinge connected to the center support member and the hinge connected to the flexible links.

16 Claims, 2 Drawing Sheets

COLLAPSIBLE CLOTHES HANGER

BACKGROUND OF THE INVENTION

1. Field of the Invention

The present invention is directed generally to a clothes hanger having collapsible arms and, more particularly, to a one-piece collapsible clothes hanger movable between a collapsed and an open position by a single, one-handed action.

2. Description of the Related Art

Clothes hangers are well known and perform the function of suspending an article of clothing from a closet rod or the like in a generally satisfactory manner. When used to hang up turtleneck sweaters or pull-over style garments, however, the fixed shape of known hangers require that one either feed the hanger through the bottom of the garment —an awkward procedure— or risk damaging the neck opening of the garment by forcing the larger hanger through it. Removing known hangers from such a garment is accomplished by reversing these steps.

In the case of buttonable garments, the top few buttons often need to be buttoned or unbuttoned in order to place known hangers in, or remove them from, such garments. Also, conventional hangers are of a size which can make storing them a problem, particularly in places such as a clothing store where space is always at a premium. Furthermore, it would be beneficial to the traveler, for example, to provide a hanger which fits readily into a small space, such as luggage pockets, purses, glove compartments and the like.

Finally, it has been well documented in recent studies of injury in the workplace that a sufficient number of certain motions can —over time— lead to debilitating injury. Simplifying the act of hanging clothes would therefore seem likely to reduce the incidence of such injuries throughout the clothing industry.

Collapsible hangers have been proposed in which the hanger arms are movable between a ready-to-use, open position and a closed, or collapsed position. For example, U.S. Pat. No. 4,673,115 discloses a unitary collapsible coat hanger of molded polypropylene having right and left hanger arms attached to a hanger body by hinge straps. Locking arms are connected to the undersides of the hanger arms below the hanger body, and a "c"-shaped spring joins the ends of the locking arms to one another. Opening and closing of the hanger requires a two handed operation since the c-shaped spring must be manipulated with one hand while the other holds the hanger. This leaves no hands free for holding the garment. Furthermore, while it may be possible to insert this hanger through a neck opening, one hand must be inserted upward through the garment to move the c-shaped spring during both the opening and collapsing operations.

In U.S. Pat. No. 4,227,632 is disclosed a flexible garment hanger having two hanger arms connected by a locking bar below the body of the hanger and including a stop member projecting from the locking bar. The hanger is opened and closed by moving this stop member upwardly into an over-center locking position in abutment with the hanger body and, respectively, by pulling down on the stop member. Again, two hands are required for operation of the hanger and one hand must be inserted into the garment for both the opening and collapsing operations.

West German published application No. 1 429 922 discloses a collapsible coat hanger having arms pivoted on a spindle and interacting with finger grips. Pulling of the finger grips upwardly relative to the hanger causes the hanger arms to open. The hanger disclosed in this German patent document has numerous component parts which would add assembly costs to the final unit price.

SUMMARY OF THE INvENTION

It is an object of the present invention to provide a one piece collapsible hanger construction which is operable by one hand thereby allowing the garment to be held with one hand while the hanger is manipulated with the other hand.

Another object of the invention is to provide a collapsible hanger having a quick, single movement opening and latching operation which can be performed while the hand is in a natural, handshake-type position.

Yet another object is to provide a hanger which automatically latches when moved to a fully open position, and which may be moved between an open position and a collapsed position and back again by exerting simple squeezing forces on the hanger while the user's hand remains outside the garment.

A further object of the invention is to provide a collapsible hanger with automatic latching and a push button release.

Yet a further object of the invention is to provide a one piece construction for a collapsible hanger which may be manufactured using a simple "pull-apart" mold.

These and other objects of the invention are achieved in a clothes hanger having a pair of hanger arms, each with a free end and an opposite end. Each hanger arm has two hinge connection locations at the opposite end, one of which is a lower, inside hinge location connected by a hinge to the bottom end of a center support member. The other hinge location is an upper, outer hinge location which is connected by another hinge to one end of a bendable link. The other end of the bendable link is connected to an opposite end of the center support. With reference to the lower, inside hinge locations, the upper, outer hinge locations of the two arms move in an arc during collapsing or opening of the hanger.

The bendable links are connected between the upper end of the center support member and the upper, outer hinge locations. The bendable links are flexible enough to permit the hinge locations to move in the above-described arc, and may be, for example, formed of straps which flex along their length. In the preferred embodiments, however, the bendable links each comprise a pair of rigid portions connected to one another by an intermediate, or elbow, hinge. When the hanger is in the open position, the rigid portions lie generally in side-by-side relation.

The center support member to which the bendable links are attached by hinges acts to pull downward on the bendable links and insure that they move into side-by-side relation during opening of the hanger. In some embodiments, this is the sole function of the center support member; however, in other embodiments the center support member is shaped to at least partially support the hanger in the open position. For example, the center support may be shaped to resist shear forces caused by a load on the hanger, or to provide an opening into which a latching means engages.

A latching mechanism, or latching means, is provided for retaining the hanger arms in the open, garment supporting position. Preferably, the latching mechanism is simple to operate and may be released by a single handed operation so that the other hand may be used to hold a garment. In one embodiment, the latching mechanism is a push button releasable latch having a pair of release button members linking the hanger arms to one another from locations intermediate the two hinge locations on each hanger arm. In other words, each of the release button members extends from between the hinge locations on one arm, respectively, to engage the other arm between its two hinge locations. Engagement of the arms by the button members is automatic when the hanger arms reach the fully open position.

As the name implies, the release button member is also used to release the latching means. A portion thereof is in the shape of a button which is depressed to release the latch. The two button shaped portions of the respective release button members are preferably generally in alignment with one another and facing in opposite directions so that a simple squeezing action on the buttons releases the latching means.

In another embodiment, a push button releasable latch with two release buttons facing in opposite directions is also provided; however, the release buttons each engage the center support member instead of the opposite hanger arms. In this embodiment, squeezing the buttons results in the center support member being deflected to release the latching means. For example, a disk-shaped center support member which is engaged by the button members twists to release the button members and permit the hanger to be collapsed.

It is also contemplated to provide a variety of alternate latching mechanisms such as the combination of a releasable hook extending between and able to engage the two bendable links of the hanger and a specially configured center support member which —when the hanger arms are opened to the desired garment-supporting position— would bear against and fix them in that position until such time as the user released the hook latch. Another possibility is a latch with only a single push button release. Other latching and releasing means are also possible and may be considered design variations of the present invention and equivalent to those disclosed herein.

The preferred embodiment of the present invention provides a hanger in which the mechanism for raising the hanger arms to the open position and for releasing the hanger arms is operable while the user's hand remains in a natural, ergonomic position. In other words, the user's hand remains in a position similar to that assumed when shaking hands without stressing the tendons in the wrist or hand. Force to the latching and release mechanisms is applied by a squeezing motion in substantially horizontal planes. In the preferred embodiments, the release force is applied generally at right angles to the direction of the latching force.

A hook is provided on the present hanger for engaging a closet rod or the like. The hook extends upward from one of the bendable links in the preferred embodiments. It is also contemplated that the hook may extend from the center support member or some other location on the present hanger. For purposes of the present invention, the term "hook" also includes other hanger types and suspension means including, for example, swivel hooks or the type of suspension means used in hotels to prevent the theft of hangers. Each of these suspension means is deemed equivalent to the disclosed hook.

The preferred embodiments of the present invention are molded of a single flexible material, such as polypropylene. Since "pull-apart" molds are significantly less expensive than so-called "side action" molds which incorporate "slides" etc., the physical configurations of the preferred embodiments of the present invention are such that they can be produced on such tooling.

DESCRIPTION OF THE PREFERRED EMBODIMENTS

Figure 1:
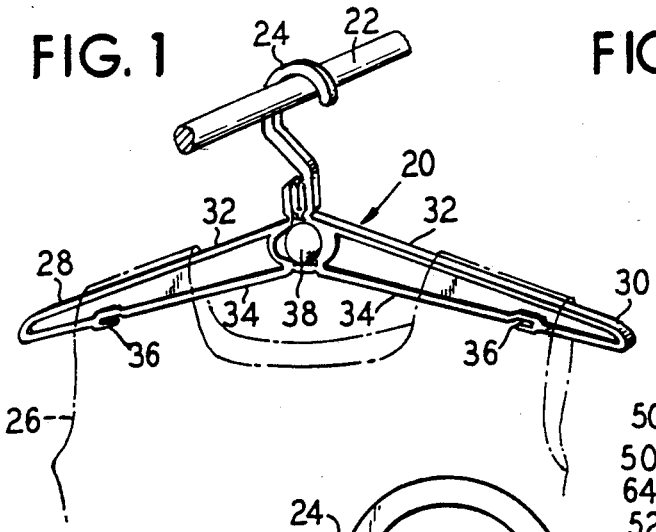
FIG. 1 is a perspective view of a collapsible hanger according to the principles of the present invention shown suspended from a clothes rod and having a garment shown in phantom hanging thereon.

An exemplary embodiment of a collapsible hanger 20 is shown in FIG. 1 hanging from a support rod 22 by a hook 24 and supporting a garment 26 on first and second hanger arms 28 and 30, respectively. A tunic type garment is show for purposes of illustration, although the present invention finds particular utility when used with garments having relatively smaller neck openings. Each of the hanger arms 28 and 30 has an upper bar 32 and a lower bar 34 with a strap hook 36 being formed in each of the lower bars 34 for holding a garment having straps. The hanger arms 28 and 30 may, however, be of a variety of configurations depending upon utilitarian, aesthetic and economic considerations. A latching, or fastening, means 38 is shown between the two arms 28 and 30 to hold the arms in the illustrated open position.

Figure 2:
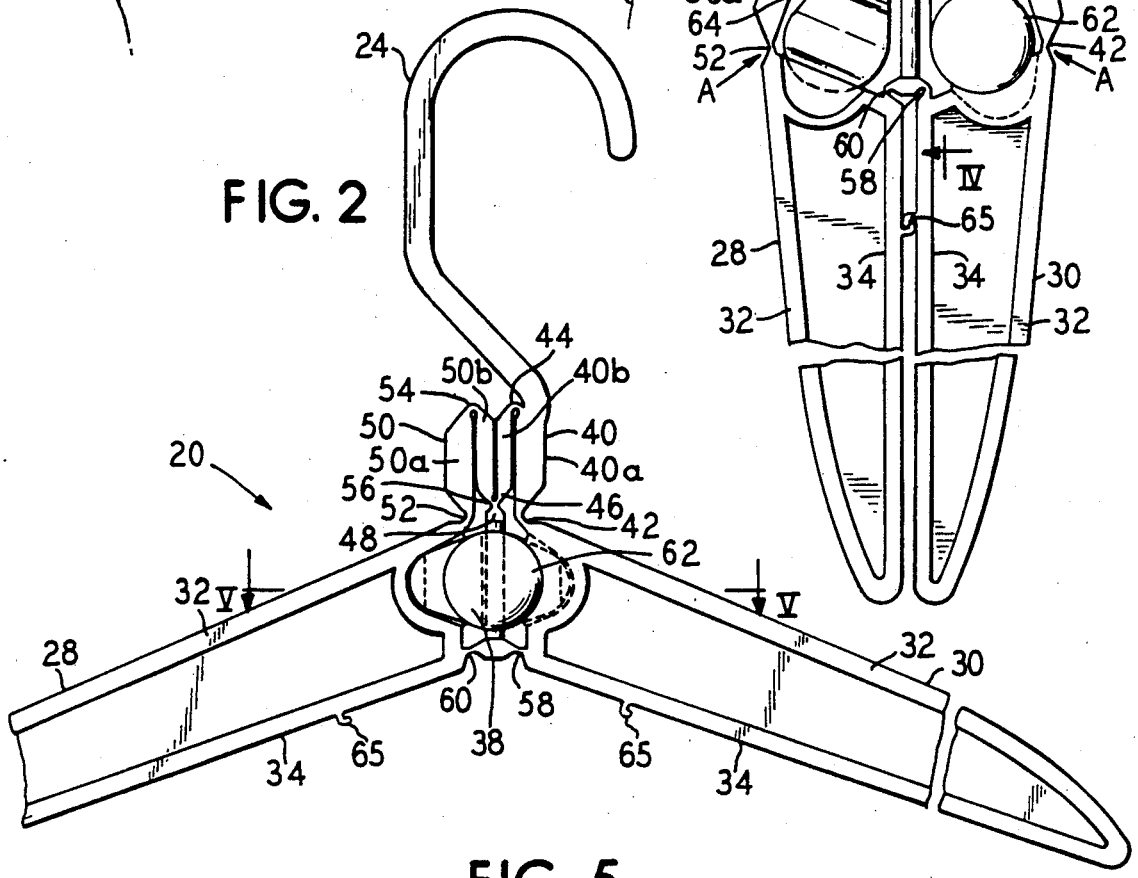
FIG. 2 is an enlarged partial front view of the hanger of FIG. 1 shown in the open position.

Referring to FIG. 2, the hook 24 is connected to a first bendable link 40 comprising link portions 40and **40*b*. The link portion 40*a* is connected by a hinge 42 to the top bar 32 of the hanger arm 30 at an upper, outer hinge location. An intermediate, or elbow, hinge 44 connects the link portions 40*a* and 40*b*** to one another.

The opposite end of the link portion 40b is connected by a hinge 46 to a center support member 48.

A second bendable link 50 having link portions 50a and 50b is connected between the upper bar 32 of the hanger arm 28 at an upper, outside hinge location and the center support member 48. In particular, a first end of the link portion 50a is connected by a hinge 52 to the upper bar 32 while, an intermediate or elbow hinge 54 connects the link portions 50a and 50b to one another, while a hinge 56 connects the link portion 50b to the center support member 48.

The center support member 48 extends substantially vertically in a downward direction from the hinges 46 and 56 to a second pair of hinges 58 and 60. The hinge 58 connects the center support 48 to the lower bar 34 of the hanger 30 at a lower, inner hinge location, while the hinge 60 connects the lower bar 34 of the hanger arm 28 to the center support 48 at the corresponding lower, inner hinge location.

The fastening means 38 includes a centrally located button 62 which is pressed to selectively release the fastening means 38, as will be described hereinafter. The button 62 is circular in outline and has a tab portion 64 extending from the left side thereof, with respect to FIG. 2, into a recess in the hanger arm 28. The button 62 is a release button portion which extends from the hanger arm 30 between the hinge locations for the hinges 42 and 58. The tab portion 64, when the hanger is in the open position shown in FIG. 2, lies between the two spaced hinge locations 52 and 60 of the hanger arm 28. Pressing on the circularly outlined button 62 releases the fastening means 38 and, therefore, the button surface may have marked thereon the word "push" or some other equivalent term. The button surface also provides a convenient place for an advertisement, such as a store name. Thus, the fastening means 38 connects the hanger arms 28 and 30 together when in the non-collapsed position shown in FIGS. 1 and 2 between the spaced hinge locations 42 and 58 and 52 and 60, respectively.

The hanger arms 28 and 30 extend in opposite directions at an angle below horizontal. In a preferred embodiment, the hanger arms 28 and 30 are at an angle of 23 degrees from horizontal, as the hanger is suspended from the hook 24. It is, of course, possible to arrange the hanger arms at other angles as well.

Figure 3:
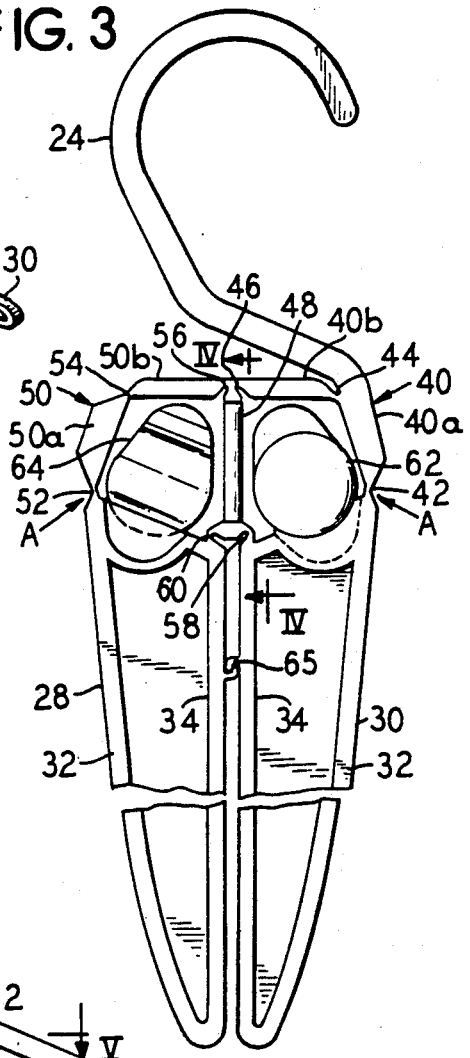
FIG. 3 is a broken front elevational view of the hanger of FIGS. 1 and 2 shown in the collapsed position.

FIG. 3 shows the collapsed position of the hanger of the first embodiment. The hanger arm 28 has been pivoted about the hinge 60 to extend in a substantially vertical downward direction while the link portions 50a and 50b have been opened up about the hinge 54 so that they no longer lie in a side-by-side relationship as shown in FIG. 2. Similarly, the hanger arm 30 extends in a downwardly direction, pivoted about the hinge 58. The link portions 40a and 40b also no longer lie in side-by-side arrangement. With the hanger arms 28 and 30 in the position shown in FIG. 3, they can easily be inserted or removed through a neck opening of a garment. The collapsed hanger also fits into a small storage space and is not as awkward to pack in a suitcase as a conventional non-collapsing hanger would be. Although the hook 24 is tilted somewhat as compared to the hook position shown in FIG. 2, it is still possible to hang the hook 24 on a clothes rod 22 or the like when in the collapsed position.

The fastening means 38 has the button portion 62 extending from the hanger arm 30, while a symmetrically configured button portion 66 extends from the hanger arm 28. Access to both sides of the button portions 62 and 66 without interference from the bendable links 40 and 50 is possible when the hanger is in the collapsed position. This permits the hanger, including the latching or fastening means 38, to be molded in one piece in a simple and relatively inexpensive pull-apart mold. The illustrated bendable links 40 and 50 along with the central support member 48 and the ends of the hanger arms 28 and 30 each outline a trapezoid. The trapezoid collapses as the hanger arms 28 and 30 are pivoted to their open position, the rigid portions 40b and 50b being pulled down by the central support member 48.

The collapsed hanger shown in FIG. 3 can easily be opened to the non-collapsed position shown in FIGS. 1 and 2 by one hand by applying a squeezing force against the surfaces immediately adjacent to the hinges 42 and 52. Through the application of the force in the directions A, the bendable links 40 and 50 fold in half about the elbow hinges 44 and 54 and move into side-by-side relation, thereby causing the downwardly directed hanger arms 28 and 30 swing out to the open position shown in FIGS. 1 and 2. When the squeezing force A is exerted after the hanger arms 28 and 30 have been inserted through the neck opening of a garment, the hanger arms 28 and 30 swing into the open garment-supporting position. To hold the hanger in the illustrated, collapsed position, a catch means 65 in the form of two small opposed hooks is provided on the bars 34 of the hanger. The catch means 65 engage one another to hold the arms 28 and 30 together such as during storage.

Figure 4:
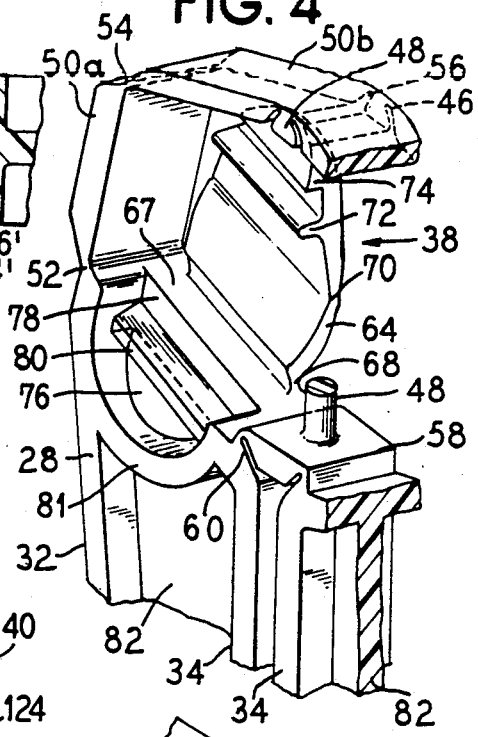
FIG. 4 is a perspective view, partially broken away along line IV—IV of FIG. 3, showing a first preferred embodiment of a fastening means for the hanger of the present invention.

Referring now to FIG. 4, details of the fastening means 38 are shown. The button portion 66 extends from a cross-bar 67 opposite the free end of the hanger arm 28, the cross-bar 67 extending between the hinges 52 and 60. The button portion 66 has a first hinge 68 at the cross-bar 67 and a second hinge 70 lying generally parallel to the first hinge 68. A part of the button portion 66 which extends beyond the hinge 70 has a fulcrum flange 72 and a latch hook 74. The latch hook 74 is on the inside surface of the tab 64. The other button portion 62 has a similar configuration and lies in a plane which is parallel to the plane of the illustrated button portion 66.

Also shown in FIG. 4 on the opposite face of the hanger from the button portion 66 is a latch receptacle 76 separated from a fulcrum engaging surface 78 by a wall 80. A substantially similar arrangement with a latch receptacle is on the other hanger arm 30 lying generally in the plane of the button portion 62. A curved wall 81 defines the outer portion of the latch receptacle 76, the curve of the wall 81 generally matching the curve of the tab 64.

As can be seen in FIG. 4, a support web 82 connects the top bar 32 and bottom bar 34 of each hanger arm 28 and 30 so that each hanger arm has a cross section generally in the shape of an I-beam. Also in FIG. 4, to better view the configuration of the button portion 66, the center support 48 is shown broken away. The center support 48 of the illustrated embodiment is of a cylindrical configuration extending from between the hinges 46 and 56 to between the hinges 58 and 60. To avoid the button portions 62 and 66 striking the center support 48, the center support 48 lies between the planes of the respective button portions 62 and 66.

Figure 5:
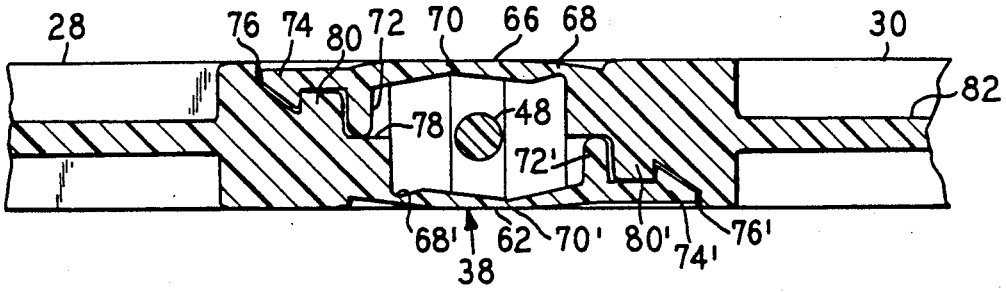
FIG. 5 is a cross section along line V—V of FIG. 2 showing the fastening means in a fastened state.

FIG. 5 shows a cross section through the fastening means 38 with the button portions 62 and 66 in the fastened position. The latch hook 74 is in the latch receptacle 76 and is held in place by engaging the wall 80. Similarly, the button portion 62 has a latch hook 74' in a latch receptacle 76' held in place by a wall 80'. The fastening means 38, thus, resists tension forces and thereby maintains the hanger arms 28 and 30 in the non-collapsed position.

Figure 6:
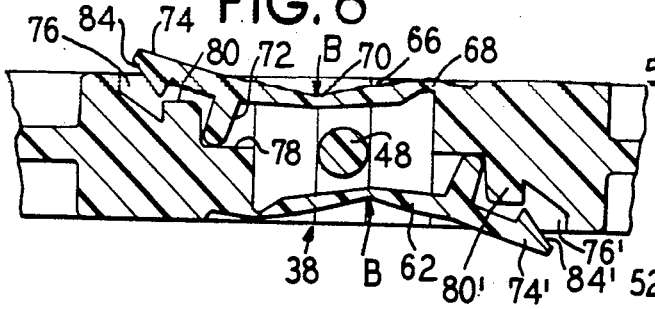
FIG. 6 is a cross section in the same direction as FIG. 5 showing the fastening means being released.

To release the fastening means 38, generally opposed forces in the direction of arrows B as shown in FIG. 6 are exerted on the button portions 62 and 66. For example, when a force is exerted in the direction of the arrow B on the button portion 66, the hinge 68 flexes in a first direction while the hinge 70 flexes in an opposite direction. As the result of the fulcrum flange 72 pressing against the fulcrum engaging surface 78, the free end of the button portion 66 thus acts as a lever which pivots the latch hook 74 out of the latch receptacle 76 and free of the wall 80. The pivoting of the hinges 68 and 70 simultaneously causes the fulcrum flange 72 to push against the wall 80 so that the hanger is moved toward the collapsed position. Upon release, the latching means thus mechanically assists the weight of the garment and molded-in "memory" of the partial plastic in lowering the hanger arms upon release. A substantially similar motion occurs with the button portion 62. Since the latch hooks 74 and 74' are no longer engaged in the latch receptacles 76 and 76', the hanger arms 28 and 30 are free to pivot about the hinges 60 and 58 and thus move to the collapsed position as shown in FIG. 3.

When placing the hanger in the non-collapsed or open position such as by squeezing in the direction A, angled faces 84 and 84' on the latch hooks 74 and 74' engage the walls 80 and 80' to cause the latch hooks 74 and 74' to move outwardly and then snap into place into the latch recesses 76 and 76'. Fastening of the latching means is thus automatic.

The foregoing embodiment is thus simple to use and provides one-handed, ergonomic operation. To release the garment 26 from the hanger as illustrated in FIG. 1, the fastening means 38 is pressed by the users hand on opposite sides in the direction of the arrows B to release the hanger arms 28 and 30 and permit them to swing to a downward position, thereby freeing the garment 26 from the hanger without requiring that a hand be inserted into the garment 26. The user's other hand may thus be used to hold the garment 26 as it is released. The present device also provides one handed operation to place the hanger in the non-collapsed position, as described above. This can also be done from outside the garment 26 without inserting a hand into and through the garment 26, even for pull-over type garment.

Although the force exerting directions A and B for the fastening step and the release step are disposed generally at right angles to one another, each lies generally in a horizontal plane, thereby permitting the user's hand to remain in a natural position without bending the wrist at an extreme angle. This avoids the problems associated with repeated bending of the wrist at extreme angles.

A second embodiment of the hanger is shown in FIGS. 7 through 11, in which the overall structure of the hanger arms 28 and 30, the hanger hook 24, and the bendable links 40 and 50 are substantially similar to the previously described embodiment, and therefore the same reference characters have been assigned to these similar parts. One difference between the two illustrated embodiments is that the embodiment in FIG. 7 includes struts 100 in the hanger arms 28 and 30 in place of the I-beam type construction of the previous embodiment. Other constructions of the hanger arms are also possible.

Figure 7:
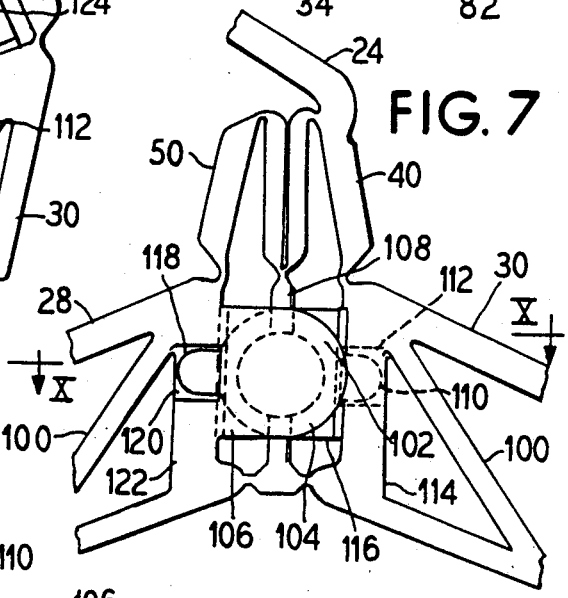
FIG. 7 is a partial front view of a fastening means of a second preferred embodiment of the hanger of the present invention.

The primary difference between the two embodiments lies in the latching means. Referring specifically to FIG. 7, the fastening means 102 of the second preferred embodiment has a button 104 on a flange 106 extending from the hanger arm 28 to a center support 108. A small projection 110, shown in phantom, from the flange 106 is inserted in an opening 112 in a crossbar 114 of the other hanger arm 30. From the hanger arm 30 extends a generally identical flange 116. The flange 116 has a projection 118 extending into an opening 120 in a crossbar 122. As will be described, both flanges 106 and 116 engage the center support 108 when in the illustrated open position. Due to the size of the flanges 106 and 116, the bendable links 40 and 50 are unable to lie completely in side-by-side relationship but instead merely lie in a generally side-by-side relationship.

Figure 8:
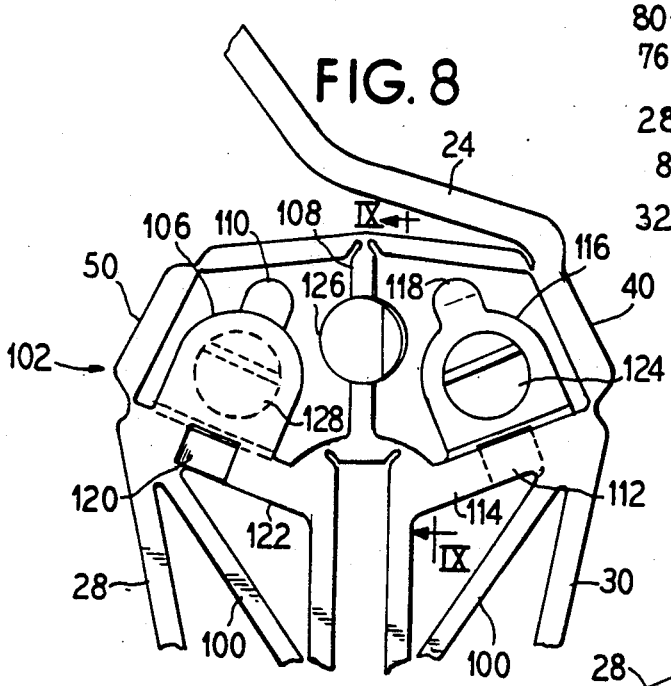
FIG. 8 is a front elevational view of the fastening means of FIG. 7 shown in the unfastened state.

Additional details are shown in FIG. 8. The flange 116 has a central recess 124 specially configured to both contain the perimeter of the disk for latching and to provide a surface for deflecting the disc for the purpose of releasing the fastening means 102 and the central support member 108 has a circular engagement member, or disk, 126 of a size and shape to fit at least partially within the recess 124. As shown in phantom, the flange 106 has a similar recess 128. FIG. 8 shows the second embodiment in the collapsed position. Like the preceding embodiment, this embodiment is also adapted to being molded in one piece in a pull-apart mold.

Figure 9:
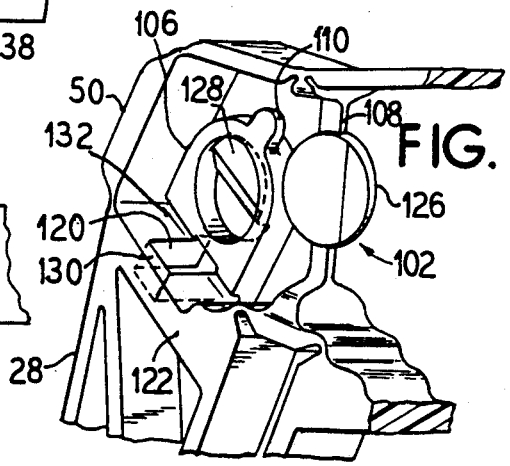
FIG. 9 is a perspective view, partially broken away generally along line IX—IX of FIG. 8, of the fastening means of the second embodiment shown in mirror image for clarity of detail.

FIG. 9 shows the relationship of the flange 106 to the opening 120 in the crossbar 122. FIG. 9 shows a mirror image reversal of the fastening means 102 relative to FIGS. 7 and 8. The opening 120 is elongated relative to the thickness of the hanger and includes a wall 130 on one end. The flange 106 is connected to the crossbar 122 by a hinge 132.

Figure 10:
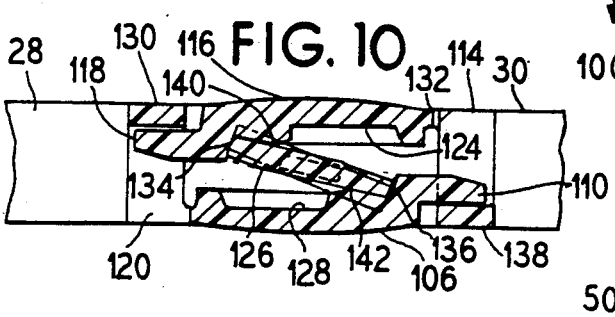
FIG. 10 is a cross section along line X—X of FIG. 7 showing the second embodiment of the fastening means in a fastened state.

The second embodiment is shown in the fastened, open position in the cross section of FIG. 10. The disk, or circular engagement member, 126 has its opposite edges engaged by edges 134 and 136 of the recesses 124 and 128. The disk 126 assumes a position as shown in phantom when not under stress. Tension on the fastening means 102 caused by the weight of garments on the hanger urges the disk 126 in a generally clockwise motion. This moves the flanges 106 and 116 mutually outwardly from one another which —if left unchecked— would result in release of the latching means. To prevent unwanted movement of the flanges 106 and 116, the wall 130 blocks movement of the projection 118 and a wall 138 blocks movement of the projection 110. The latching means 102 is, thus, latched in position.

Figure 11:
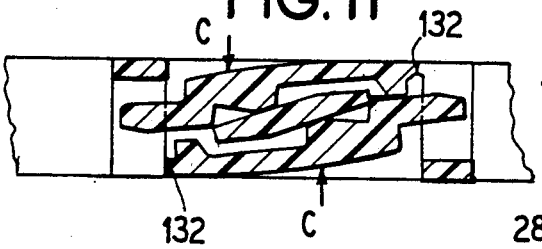
FIG. 11 is a cross section generally in the same direction as FIG. 10 showing the second embodiment of the fastening means being released.

Release of the latching means 102 is accomplished as shown in FIG. 11 by applying a squeezing force in the direction of the arrows C to the outside surfaces of the flanges 106 and 116, and more particularly to the button portions thereof. The flanges 106 and 116 pivot about the hinges 132 while the projections 110 and 118 move within the openings 112 and 120. The two part recesses 124 and 128 have deflection surfaces 140 and 142 which engage the disk 126 on either side of center and cause it to twist. The twisting motion moves the edges of the disk 126 out of engagement with the engaging surfaces of the recesses 124 and 128, thereby releasing the latching means. Latching is automatic, by simply squeezing the opposite sides of the bendable links as with the previous embodiment.

Thus, there have been shown and described various embodiments of a collapsible one piece clothes hanger which is operable by one hand, easily molded in a single step using a relatively simple "pull-apart" mold, and which is easy on the hand and wrist when used.

Although other modifications and changes may be suggested by those skilled in the art, it is the intention of the inventor to embody within the patent warranted hereon all changes and modifications as reasonably and properly come within the scope of his contribution to the art.

We claim:

1. A collapsible clothes hanger; comprising;
a hook means for suspension of the hanger;
first and second arms each of an elongated shape having first and second opposite ends, said first ends of said first and second arms each having two spaced support locations said second ends being free ends;
a central member between said first ends of said first and second arms;
first and second hinges connecting first ones of said two spaced support location to said central support member;
first and second link members connected by further hinges between second ones of said two spaced support locations of corresponding ones of said first and second arms on one hand and said central support member on the other hand, said first and second link members being bendable:
fastening means for fastening said first and second arms in an extended position; said fastening means being releasable to permit said first and second arms to move to a collapsed position by pivoting about said first and second hinges; and
said hook member extending from said first link member.

2. A collapsible clothes hanger as claimed in claim 1, wherein said hanger is formed in one piece.

3. A collapsible clothes hanger as claimed in claim 1, further comprising:
means for fastening said arms in said collapsed position.

4. A collapsible clothes hanger as claimed in claim 2, wherein said hanger is of a plastic material and said hinges are thin webs of plastic.

5. A collapsible clothes hanger as claimed in claim 1, wherein said fastening means is constructed and formed such that said fastening means is fastenable and releasable by a user's hand while said hand remains in a natural position.

6. A one-piece folding clothes hanger as claimed in claim 1, wherein said fastening means extends from between said two hinge connection locations of at least one of said hanger arms.

7. A collapsible hanger as claimed in claim 1, wherein said fastening means includes a pressable release member extending from one of said first and second arms at said first end, said release member engaging said central support member when in a fastened condition.

8. A one-piece folding clothes hanger as claimed in claim wherein said fastening means fastens to an opposing one of said pair of hanger arms between said two hinge connection locations.

9. A one-piece folding clothes hanger as claimed in claim 8, wherein said fastening means includes a push-button release.

10. A one-piece folding clothes hanger as claimed in claim 9, wherein said fastening means includes a push-button release operable from a direction opposite said first-mentioned push button release.

11. A one-piece folding clothes hanger as claimed in claim 6, wherein said fastening means fastens to said central support member.

12. A collapsible clothes hanger comprising;
a hook means for suspension of the hanger:
first and second arms each of an elongated shape having first and second opposite ends, said first ends of said first and second arms each having two spaced support locations, said second ends being free ends:
a central support member between said first ends of said first and second arms:
first and second hinges connecting first ones of said two spaced support location to said central support member:
first and second link members connected by further hinges between second ones of said two spaced support locations of corresponding ones of said first and second arms on one hand and said central support member on the other hand, said first and second link members being bendable;
fastening means for fastening said first and second arms in an extended position, said fastening means being releasable to permit said first and second arms to move to a collapsed position by pivoting about said first and second hinges; and
wherein said further hinges include;
a third hinge connecting one end of said first link to said second of said two spaced support locations of said first arm;
a fourth hinge connecting another end of said first link to said central support member;
a fifth hinge connecting one end of said second link to said second of said two spaced support locations of said second arm; and
a sixth connecting another end of said second link to said central support member.

13. A collapsible clothes hanger as claimed in claim 12 further comprising;
a seventh hinge intermediate said ends of said first link so that said first link is bendable; and
an eight hinge intermediate said ends of said second link so that said second link is bendable.

14. A one-piece folding clothes hanger comprising;
a hook means for suspension of the hanger;
first and second arms each of an elongated shape having first and second opposite ends, said first ends of said first and second arms each having two spaced support locations said second ends being free ends;
a central support member between said first ends of said first and second arms;
first and second hinges connecting first ones of said two spaced support location to said central support member;
first and second link members connected by further hinges between second ones of said two spaced support locations of corresponding ones of said first and second arms on one hand and said central support member on the other hand said first and second link members being bendable;
fastening means for fastening said first and second arms in an extended position said fastening means being releasable to permit said first and second arms to move to a collapsed position by pivoting about said first and second hinges; and wherein a portion of said hook means forms part of one of said bendable links.

15. A one-piece folding clothes hanger, comprising;

a hook means for suspension of the hanger;

first and second arms each of an elongated shape having first and second opposite ends, said first ends of said first and second arms each having two spaced support locations said second ends being free ends;

a central support member between said first and second arms;

first and second hinges connecting first ones of said two spaced support location to said central support member;

first and second link members connected by further hinges between second ones of said two spaced support locations of corresponding ones of said first and second arms on one hand and said central support member on the other hand, said first and second link members being bendable;

fastening means for fastening said first and second arms in an extended position, said fastening means being releasable to permit said first and second arms to move to a collapsed position by pivoting about said first and second hinges; and wherein each of said links is formed of two substantially rigid portions connected by an intermediate hinge.

16. A collapsible hanger as claimed in claim 7, wherein said fastening means includes a second pressable release member extending from another of said first and second arms.

* * * * *